United States Patent [19]

Vöhringer

[11] Patent Number: 4,860,411

[45] Date of Patent: Aug. 29, 1989

[54] THREAD SEPARATOR FOR SEAMING MACHINES

[75] Inventor: Fritz Vöhringer, Heidenheim, Fed. Rep. of Germany

[73] Assignee: F. Oberdorfer GmbH & Co. KG, Industriegewebe-Technik, Heidenheim, Fed. Rep. of Germany

[21] Appl. No.: 136,694

[22] Filed: Dec. 22, 1987

[30] Foreign Application Priority Data

Apr. 30, 1987 [DE] Fed. Rep. of Germany ..... 3714517

[51] Int. Cl.[4] ..... D03D 3/04

[52] U.S. Cl. ..... 28/141; 28/202

[58] Field of Search ..... 28/141, 202, 201, 203, 28/204, 205, 206, 207

[56] References Cited

U.S. PATENT DOCUMENTS 977,166 11/1910 Colman ..... 28/202
1,207,249 12/1916 Wenzch ..... 28/202
4,581,794 4/1986 Oldroyd et al. ..... 28/141

FOREIGN PATENT DOCUMENTS 536421 10/1931 Fed. Rep. of Germany ..... 28/202
1285957 12/1968 Fed. Rep. of Germany ..... 28/202

*Primary Examiner*—Robert R. Mackey
*Attorney, Agent, or Firm*—Gifford, Groh, Sheridan, Sprinkle and Dolgorukov

[57] ABSTRACT

The invention concerns a thread separator for seaming machines, especially the seaming of dewatering webs, drying webs, felts and so on.

The object underlying the invention consists therein to optimize the reliablility of the function of the thread separator by configuring their gripper needles such that the singling out of each foremost thread of a row of warp threads of the web is ensured and each piercing and taking with of the following thread is avoided.

It is proposed to construct the gripper needles as separator needles, providing them with special hooks, of which at least two are located with respect to the upper side and the lower side of the web strip related to the row of threads in the same or parallel level opposite to one another, the tips thereof being directed to the opposing thread surface, respectively. The separator needles are provided with concave apertures adapted to the diameter of the thread which is to be separated on grasping it. These apertures are configured thus that piercing of the thread to be separated by the tips and catching the following thread are avoided.

8 Claims, 3 Drawing Sheets

THREAD SEPARATOR FOR SEAMING MACHINES

FIELD OF THE INVENTION

The present invention relates to a thread separator for seaming machines, especially for the seaming of dewatering webs or fabrics, drying webs or fabrics, felts and similar flat material, comprising a separator head positioned at a level which is essentially normal to a plane of a row of threads of the web or fabric which are to be separated from one another, which separator can be moved across the plane and can be promoted against said row of threads. The separator head is provided with an arm gripping behind said row of threads and having an entry gap for said row of threads as well as a gripper needle positioned within the separator head and movable by a controllable driving means with respect to said row of threads within a guiding groove.

DESCRIPTION OF THE PRIOR ART

Thread separators of the above mentioned kind are necessary for the isolation of threads in the manufacture of the seam in order to close open woven fabrics by means of an auxiliary warp. For that purpose, the warp thread ends of the fabric which are maintained on both sides of the auxiliary warp in a magazine or storage bundle are introduced in an alternating sequence from both sides into the shed formed by the auxiliary warp. An automation of the whole seam forming operation has the precondition that this operation runs without difficulties insofar as the thread separator for the separation of the ends of the warp thread grips only one thread and separates only one thread from the row of threads. This gripping operation must absolutely avoid impaling the thread which is to be separated by the thread separator.

The known thread separators do not fulfill this requirement in a reliable way.

SUMMARY OF THE PRESENT INVENTION

It is therefore an object of the invention to provide a thread separator avoiding the above mentioned draw backs and to optimize the function of the thread separator by providing the thread separator with gripper needles which are configured to reliably separate each foremost thread of a row consisting of longitudinal thread ends of the web. In this connection, it is a further object to configure the gripper needles such that any tapping and taking along with the following thread is avoided.

These and other objects are solved according to the invention by configuring the gripper needles as separating needles being provided with hooks, at least two of which are oppositely positioned in the same level or in parallel levels with respect to the upper side and the lower side of the thread row of the respective web. The tips of those hooks are directed to the opposing surface of the thread, respectively, and the concave apertures of the hooks conform to the diameter and the form of the single threads which are to be received and simultaneously separated such that tapping of the threads which are to be separated by the tips and carrying along the following thread is avoided.

This construction ensures by means of the hook system consisting of at least two hooks of at least one separating needle opposing one another. Each hook is adapted to conform to the dimension of the respective threads which are to be separated. Each hook is aligned to come from either the running side direction or paper side direction to single out and grip the foremost warp thread of a row of threads. The construction being such that a respective one of the hooks is always matched with one particular type of thread and/or one side of the web.

DESCRIPTION OF THE DRAWINGS

The invention will be described in detail herein below with reference to the embodiments thereof illustrated in the drawings, in which.

DETAILED DESCRIPTION OF THE PREFERRED EMBODIMENTS OF THE PRESENT INVENTION

Figure 1:
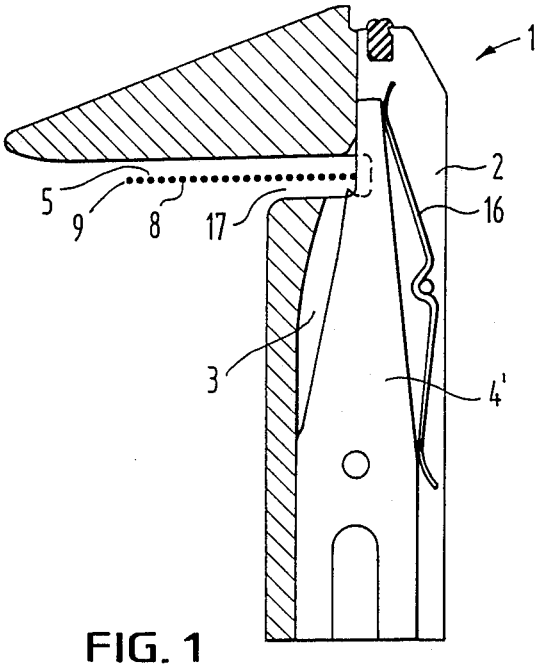
FIG. 1 PRIOR ART
FIG. 1 is a longitudinal section of a thread separator provided with a common gripper needle.
Figure 2:
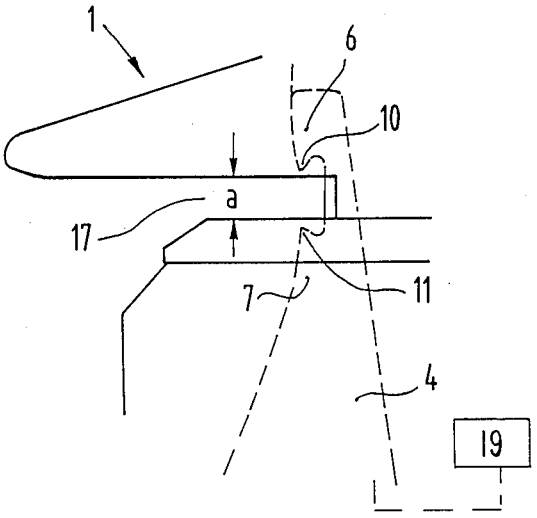
FIG. 2 is a schematic longitudinal section view of a thread separator comparable with that of FIG. 1, provided, however, with a separating needle according to the invention.

The thread separator as shown in FIG. 1 is known. A preferred embodiment of the thread separator according to the invention is shown in FIG. 2 wherein a gripper needle 4 is provided with two hooks. Like parts in the various figures are provided with the same reference numeral. A thread separator 1 is provided with a separating head 2 which is located within a plane being essentially perpendicular to the plane of the row 9 of threads 13 (FIGS. 3 and 4), which are to be separated, i.e., to be singled out, which separating head is movable in that plane against the row of needles.

Within the separating head 2, there is at least one gripper needle 4 which is shiftable by a controllable driving means with repsect to the row of threads and thereby movable within a groove 3 of the separating head under the force of a spring 16. This gripper needle is configured as a separating needle 4.

Figure 3:
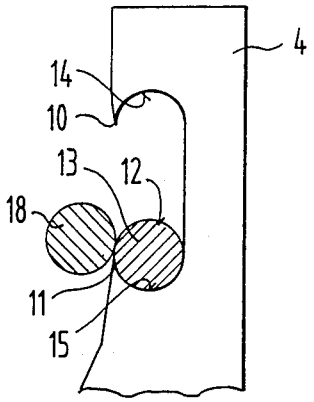
FIG. 3 is a schematic section view of the double hook of the separating needle according to the invention provided with a separated or single-out thread within the lower hook.
Figure 4:
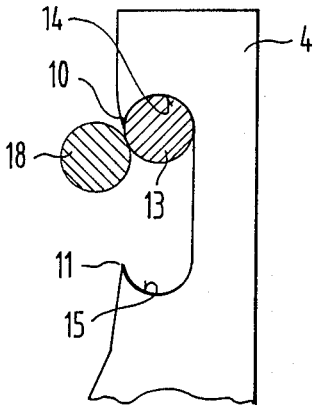
FIG. 4 is a schematic view comparable with that of FIG. 3 of a double hook according to the invention provided with a separated or single-out thread within the upper hook.

The separating needle or needles are provided with at least two hooks 6, 7 arranged opposite to one another in the same level with respect to the upper side 5 and the lower side 8 of a strip of web or magazine bundle belonging to the row of threads 9. The tips 10, 11 of the hooks are each directed to the opposing thread surface 12. Each hook 6, 7 is provided with a concave aperture 14, 15 which, as shown in FIGS. 2, 3 and 4, are located in the separating needle 4. The concave apertures 14, 15 have a radius of curvature corresponding to the curvature of a surface 12 of the thread 13. Thus, the radius of curvature could also be curved differently for adaptation to the size and shape of thread 13 which is to be received during the separating operation.

The length of the arc of the curvature of the concave apertures 14, 15 of the hooks 6, 7 corresponds, in case of a circular thread cross section as shown in FIGS. 3 and 4, in general to half of the circumference of the thread. In each case, the configuration of the hooks 6, 7 is chosen such that thread 13 which is to be separated cannot be pierced by the corresponding tip 10, 11 and, thus the following thread 18 is not taken along with thread 13 which is to be separated during the separation operation.

Figure 5:
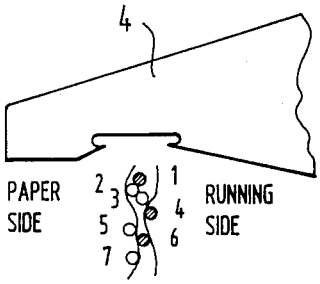
FIG. 5 is a schematic partial side view of a separating needle according to the invention having a pair of hooks suitable for use with a double layered web.
Figure 6:
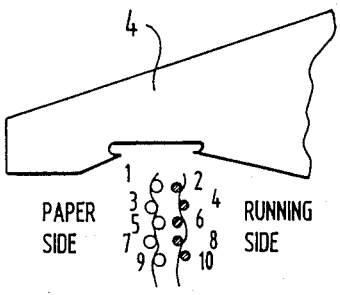
FIG. 6 is an alternative embodiment of a separating needle according to the invention for use in separating threads of a compound web.
Figure 7:
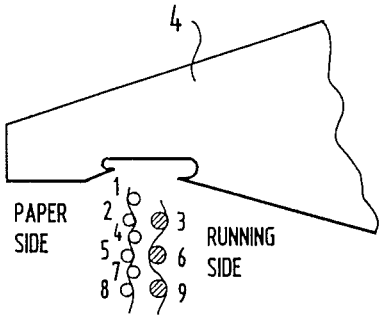
FIG. 7 is an alternative embodiment of a separating needle according to the invention for use in separating threads of a compound web.

For that purpose, the distance between the tips 10, 11 of the hooks 6, 7 with respect to one another is chosen such that, as can be gathered from FIG. 2, the distance corresponds approximately to the width (a) of the entry gap 17 for the thread row 9 provided within the separating head 2. This width of the entry gap 17 is adapted to accomodate the web thickness and is between about 0.5 and 3.0 mm. In this connection, a width of 1.0 mm is found to be essentially advantageous. In addition to the width of the entry gap, for the optimum functioning of the thread separator, a narrow guiding groove without rounded edges is provided in the separating head so that in case the configuration of the hooks or separating needles, respectively, and of the guiding groove and the width of the entry gap are correspondingly related to one another even a tension pressure control of the strip of the web is not necessary in order to ensure the requested functioning of the thread separator, i.e. in order to avoid that, on singling out the thread 13, the following thread 18 is pierced and taken along with thread 13. Thus, on using a separating needle provided, for instance with a double hook, within the thread separator according to the invention, weaving faults in the seam may be avoided by preventing the simultaneous weaving of two threads. FIGS. 5 through 7 show schematically in a partly lateral view a separating needle 4 with its double hook according to the invention showing the manner the needle singles out the threads of different types of webs.

Using the separating needle for double layered webs such as Duoform-webs, the two hooks of the needle, which are in FIGS. 2 through 4 designated by numerals 6 and 7, but not specifically designated in FIGS. 5 through 7, are adapted to correspond to the diameters of the warp thread and catch the foremost warp thread arriving dependent on control from the running side direction or paper side direction, in order to single out that warp thread. The control of the separating needles 4 takes place in this connection through a programmed cam in a cam switching means or on jacquard-seaming through programmed needles and the corresponding programmed jacquard-card 19. The numerals 1 through 7 (FIG. 5), 1 through 10 (FIG. 6) and 1 through 9 (FIG. 7) and their relationship to the sides show the series and the relationship of engaging steps caused by the hooks. Thus, the double layered web such as a Duoform-web according to FIG. 5 needs the left or lower hook of the separating needle 4 in order to single out the warp threads 2, 3, 5 and 7 on the paper side of the web, whereas the right, upper hook of the separating needle singles out the warp threads 1, 4 and 6 on the running side of the web. In this connection, as shown in FIG. 5, one can recognize that with double layered webs, the second and thrid warp thread on the paper side are subsequently singled out or caught, respectively, and that all remaining warp threads are singled out alternately between the running side and the paper side. The mode of function of the thread separator according to the invention or of the separating needle 4 with double hooks used therein on singling out of threads of a compound web is shown in FIG. 6. In this case, the paper side and the running side of the web is alternately grasped by the lower or upper hook, respectively.

In case of another compound web as shown as by FIG. 7, the singling out of the warp threads takes place alternately on the paper side or paper side and running side of the web, wherein a small hook is used for the paper side and a large hook is used for the running side, as can be gathered from the different diameters of the threads of the paper side and running side shown in section as well as from the different hook sizes of the double hooks of that separating needle.

The construction according to the invention has moreover the advantage that the separating needle 4 fits into each standard thread separator and each such thread separator may be changed in this connection with only a small cost. Moreover, the improvement of the functioning does not only lead to the fact that the simultaneous singling out of two subsequent threads is avoided, but also to the fact that the adjustment of the thread separator is simplified.

Figure 8:
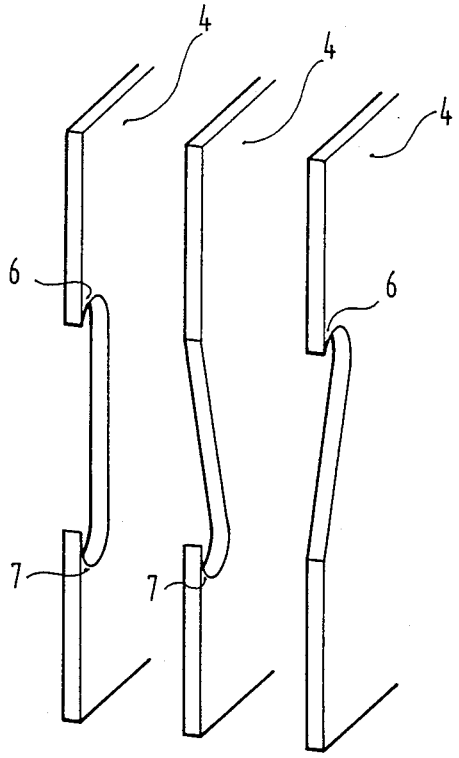
FIG. 8 is an exploded partial perspective view of an alternative embodiment of the invention having three separating needles in accordance with the invention.

For many webs, it is sufficient to work with only one separator needle in the separating head, the opposing hooks thereof are configured dependent from the web. In webs provided with several different thick types of longitudinal threads, it may be necessary, however, to position several separator needles one upon the other in the guiding groove, moving each needle independently and separating the threads of the type of thread related thereto according to a control program. As can be gathered from FIG. 8, the separator needles can also be provided with only one hook, in which case attention is drawn to the fact that at least two hooks of all the hooks must be arranged opposite to one another.

It is expressly stated that the invention is not limited to definite, for instance circular, configurations of hooks. It goes without saying that the apertures may also be adapted to profile threads, for instance flat wires.

I claim:

1. A thread separator for seaming machines especially for use in seaming dewatering webs of a type having a web having an upper side and a lower side and formed of a row of threads, said thread separator comprising:

a separating head positioned on a level generally perpendicular to said row of threads, said separating head being movable along said level and selectively shiftable against said row of threads of said web, said separating head having an arm extending on one side of said row of threads, said separating head having an entry gap for accepting said row of threads;

at least one gripper needle shiftable within a guiding groove of said separating head, said at least one gripper needle having at least one first hook and at least one second hook, said at least one first and at least one second hooks disposed on said at least one gripper needle in directions opposite to one another, each of said at least one first and second hooks having a concave aperture forming a point on one side of said at least one needle, each said point being aligned in a direction towards a thread of said row of threads to be separated, said concave aperture having a diameter corresponding to a diameter of said thread to be separated such that said thread to be separated is separated from a following thread by said point without engaging said following thread; and means for selectively shifting said at least one gripper needle.

2. The thread separator according to claim 1, characterized in that said thread separator includes only one separating needle.

3. The thread separator according to claim 1, characterized that each of said at least two apertures of said hooks are provided with a similar radius of curvature.

4. The thread separator according to claim 1, characterized in that a length of said arc of curvature of said concave apertures of the hooks corresponds generally to half of the circumference of said thread.

5. The thread separator according to claim 1, characterized in that the distance between said tips of said hooks from one another is at least as large as the width of said entry gap.

6. The thread separator according to claim 1, characterized in that said means for selectively shifting said separating needle is realized by a programed cam controlled by a programable means for switching.

7. The thread separator according to claim 6, characterized in that the control of said separating needle is accomplished through a sensor means which is activated by a corresponding programed jacquard-card.

8. The thread separator according to claim 1, characterized in that the width of the entry gap is 0.05 mm larger than the thickness of said web.

* * * * *